US005493759A

United States Patent [19]

Salice

[11] Patent Number: 5,493,759

[45] Date of Patent: Feb. 27, 1996

[54] ARTICULATED FURNITURE HINGE HAVING A PIVOTALLY ADJUSTABLE HINGE ARM PRODUCING LATERAL OR VERTICAL MEMBER TRANSLATION

[75] Inventor: Luciano Salice, Carimate, Italy

[73] Assignee: Arturo Salice, S.p.A., Novedrate, Italy

[21] Appl. No.: 164,345

[22] Filed: Dec. 9, 1993

[30] Foreign Application Priority Data

Dec. 10, 1992 [DE] Germany ..... 42 41 690.6

[51] Int. Cl.[6] ..... E05D 7/04

[52] U.S. Cl. ..... 16/238; 16/245

[58] Field of Search ..... 16/236, 237, 238, 16/240, 241, 366, 370, 357, 360, 242, 245

[56] References Cited

U.S. PATENT DOCUMENTS

| | | | |
|---|---|---|---|
| 3,442,421 | 5/1969 | Donahue . | |
| 4,517,706 | 5/1985 | Lautenschlager et al. | 16/238 |
| 4,620,343 | 11/1986 | Grass | 16/236 |
| 4,698,877 | 10/1987 | Lautenschlager, Jr. et al. | 16/236 |
| 5,144,722 | 8/1992 | Salice | 16/240 |

*Primary Examiner*—Mark Rosenbaum
*Assistant Examiner*—Kenneth J. Hansen
*Attorney, Agent, or Firm*—Morgan & Finnegan

[57] ABSTRACT

A furniture hinge having a movable hinge part (40) adapted to be mounted on a door and is connected by at least one pivot pin in an articulating manner with a hinge arm (1), which is adapted to be mounted on the supporting wall (3) by means of an attachment plate (4 and 5). The hinge arm (1) is locked in relation to the attachment plate by means of a set screw (26) which is able to be screwed into the hinge arm and able to be turned with the attachment plate (4 and 5) but not be moved in an axial direction. In order to provide a furniture hinge which has a compact design and is able to be attached to narrow end frame of openings in furniture and which, furthermore, renders possible a pivotal movement of the hinge arm for the purpose of lateral adjustment of a door without altering the gap, in an arm (21) partly overlapping the end side (48) of the supporting wall or of the end frame (3) the attachment plate (4 and 5) is provided with a slot (22) running parallel to the end side (48), which slot (22) parallels the pivot axis of the hinge arm and is in alignment with a slot (47) in the end part, adjacent to the joint, of the hinge arm.

10 Claims, 3 Drawing Sheets

ARTICULATED FURNITURE HINGE HAVING A PIVOTALLY ADJUSTABLE HINGE ARM PRODUCING LATERAL OR VERTICAL MEMBER TRANSLATION

BACKGROUND OF THE INVENTION

The invention relates to a furniture hinge comprising a movable hinge part which is adapted to be connected with a door, is preferably pot-shaped, and is, furthermore, connected in an articulating fashion with a hinge arm by at least one pivot pin, the arm being able to be connected by an attachment plate with a supporting wall and being able to be set by means of a set screw which is screwed into the arm and is able to be turned with the attachment plate, but is connected so that it is locked in the axial direction, for lateral or vertical adjustment of the door to different angular settings in relation to the attachment plate.

If, for lateral adjustment of the door, the hinge arm, which is pivotally connected with the movable hinge part by two links, is swung away from the attachment plate, it will assume a position to an obtuse angle in relation to the door, which corresponds to a slight opening of the door, although the door is located in its closed position owing to its resting on parts of the body of the furniture or on the door frame thereof. If the links are pivoted by this sort of lateral adjustment towards a position in which the door is slightly opened, the gap, that is to say the distance between the end surface of the supporting wall and the door, will be increased. In the case of a four joint furniture hinge, such as that disclosed in the U.S. Pat. No. 4,701,979 and of the type initially mentioned, the change in the gap caused by the swinging of the hinge arm for lateral adjustment is compensated for because the hinge arm is so guided in guides in the attachment plate that on swinging an amount equal to the change in the gap caused by such swinging, it is shifted in its longitudinal direction on the intermediate plate. In the case of this known furniture hinge, the hinge arm is so guided in guides on the attachment plate that a translatory movement modulates the pivotal movement between these two parts, such movement in translation compensating for the change in the gap by pivoting the links. This known furniture hinge however necessitates such a long length of the hinge arm and of the attachment plate that the hinge arm may be mounted in a longitudinal sliding fashion on the attachment plate. There are, however, types of furniture in the case of which there is no space for the arrangement and attachment of long hinge arms, and correspondingly, long attachment plates, as for example in the case of furniture of American design, in which doors have to be attached on a surrounding front frame with only a limited width.

STATEMENT OF THE INVENTION

Accordingly, one object of the invention is to provide a furniture hinge of the sort noted initially which, while having a compact manner of construction allowing an attachment of the attachment plate bearing the hinge arm, for example even on narrow end frames of a furniture opening, renders possible a swinging of the hinge arm for the purpose of lateral adjustment of a door without changing the gap.

In accordance with the invention this object is achieved in the case of a furniture hinge of the type initially mentioned since the attachment plate is provided in an arm, which partly overlaps the end side of the supporting wall or of an end frame, having a slot which is parallel to the end side and parallel to the pivot axis of the hinge arm and which is in alignment with a slot in the end part in the joint side of the hinge arm, and is held in the slots of the pivot pins, and the slot so extends in the end part on the joint side of the hinge arm obliquely or transversely in relation to the slot in the arm of the attachment plate such that the pivot pin is shifted in position, on swinging of the hinge arm, in the slot provided in this arm. In the furniture hinge in accordance with the invention the gap between the door and the body part of the piece of furniture or, respectively, the end frame thereof, is maintained constant because at least one of the pivot pins journaled on the hinge arm is so guided in the intersecting slots of the hinge arm and of the support plate that the pivot pin or pins constituting the joint system are shifted in position on swinging the hinge arm generally parallel to the end side of the body of the piece of furniture.

If the hinge in accordance with the invention only possesses a single pivot pin, the latter is guided in two slot guides of which the guide provided on the attachment plate extends in parallelism to the end wall of the furniture and the other guide provided on the hinge arm is set obliquely to the same in such a manner that on swinging the hinge arm the pivot pin is shifted parallel to the end wall of the furniture.

If the movable hinge part is connected two links with pivot pins, arranged rectangularly or in a trapezium, with the hinge arm, it is possible for the pivot pins on the hinge arm to be guided in slots, arranged in parallelism to the end side, in the attachment plate and in slots intersecting the latter in the hinge arm.

In accordance with a preferred embodiment of the invention, in the case of a four joint hinge only one pivot pin on the hinge arm is guided. In the case of this embodiment of the invention, the inner pivot pin is secured in holes in the hinge arm and only the outer pivot pin is held in the intersecting guides of the hinge arm and of the attachment plate, the inner pivot pin being so arranged in relation to the pivot axis of the hinge arm so that during such swinging it performs a movement which is essentially parallel to the slot in the arm of the attachment plate. The inner pivot pin in this case does not need any guide means, since the pivot axis in the rear part of the hinge arm is so selected that, although the inner pivot pin is moved along a circular arc during swinging of the hinge arm, such circular arc, however, generally corresponds to the guiding action on the chord parallel to the end side of the body of the piece of furniture.

It is convenient if the slots are provided in fork limbs of the attachment plate and of the hinge arm. These limbs are normally present, since the hinge arm and, furthermore, the attachment plate have a U-shaped form.

It is also convenient for the attachment plate to consist of a base plate and an intermediate plate. In the case of such a design, the hinge arm is preferably bearinged for swinging movement on the intermediate plate and is able to be locked in various different angular positions.

Another advantageous feature of the invention is that for gap adjustment the intermediate plate is held in a longitudinally sliding fashion on the base plate and can be locked thereon. For longitudinal shifting of the intermediate plate on the base plate it is possible to provide a self-locking eccentric drive.

A significant feature of the present invention is that in the course of swinging of the hinge arm there is an equal but opposite swinging of at least the outer pivot pin bearinged on the hinge arm, the links bearinged by the pivot pin being shifted generally parallel to the end wall of the furniture so that the mechanical advantages in the link system are not modified and the door is able to be adjusted laterally on the body of the furniture without modification of the gap once it has been set. Due to this type of parallel displacement of the link system without swinging, there is no slight opening of the door when a lateral adjustment is performed, which might cause a change in the gap.

If appropriate, furthermore, both pivot pins might, for example, be guided on the hinge arm and the attachment plate in slot guide means, if the pivot axis of the hinge arm should be in a particularly unsuitable position, so that both pivot pins bearinged on the hinge arm will move obliquely along a circular arc in relation to the end wall of the furniture in the case of a swinging movement of the hinge arm.

In accordance with the invention the pivot pins bearinged on the hinge arm are so guided in guides in the hinge arm and the attachment plate that the pivot pins bearinged on the pivoting hinge part are shifted generally parallel to the end side of the body of the piece of furniture, additional guides being provided in the hinge arm which ensure parallel displacement of the joint without any substantial rotation. If the pivot axis of the hinge arm is essentially perpendicular to the chord of the circular arc described by the inner pivot pin, it is possible to do without such guiding in intersecting slot guide means.

The pivot pin held in intersecting slot guide means is held in the shared free space of the overlapping parts of the slots without substantially any play.

THE DRAWINGS

One embodiment of the invention will be described in more detail with reference to the drawings.

FIG. 1 is a longitudinal section taken through a hinge of the type in accordance with the invention with four joints attached to the end frame of a cupboard or the like.

DESCRIPTION OF THE PREFERRED EMBODIMENTS

Figure 2:
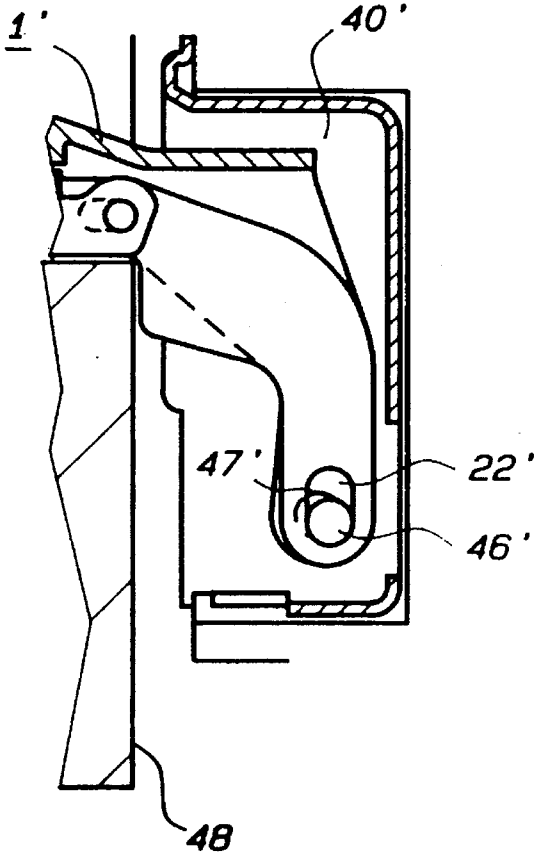
FIG. 2 is a longitudinal section similar to that of FIG. 1 taken through a hinge in accordance with the invention with only one pivot pin connecting the movable hinge part with the hinge arm.

The hinge arm 1 of the hinge in accordance with the invention is mounted on the end frame 3 of a piece of furniture by means of an attachment plate 2. The attachment plate 2 consists of the base plate 4 and the intermediate plate 5 guided in a longitudinally sliding fashion on the same.

Figure 5:
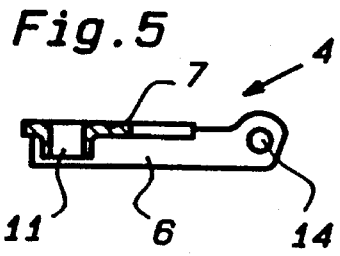
FIG. 5 is a longitudinal section taken through the base plate of the hinge of FIG. 1.
Figure 6:
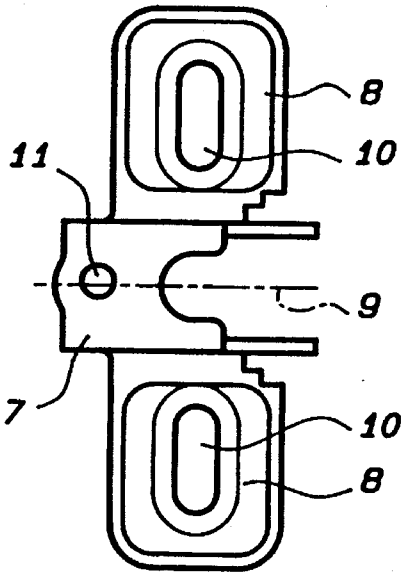
FIG. 6 is a plan view of the base plate of the hinge of FIG. 1.

The base plate has, as best shown in FIGS. 5 and 6, a U-shaped configuration. The limbs 6 of the base plate 4 are extended towards the movable hinge part past the web part 7 connecting the limbs. The limbs are connected with lateral extensions 8, which are provided with slots 10 running transversely in relation to the center line 9 and which serve for the attachment by mounting screws (not illustrated) on part of a piece of furniture. The web part 7 is provided with a front recess and a skirted hole 11, in which the shank 12 of an eccentric is held in a fashion preventing axial sliding, while allowing rotation, by riveting its lower end.

In the front part of the limbs are provided with a hole 14, in which a pin 15 is held, whose ends laterally extend past the limbs 6.

Figure 7:
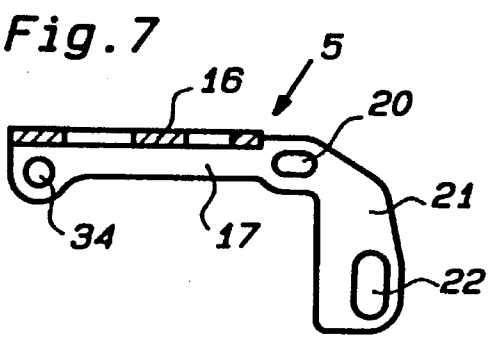
FIG. 7 is a longitudinal section taken through the intermediate plate of the hinge of FIG. 1.
Figure 8:
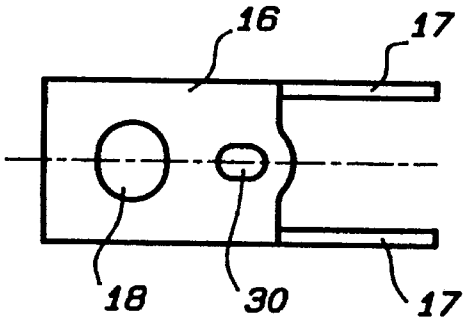
FIG. 8 is a plan view of the intermediate plate of the hinge of FIG. 1.

The intermediate plate 5 consists, as best shown in FIGS. 7 and 8, of a center web part 16, from which lateral fork limbs 17 are bent at a right angle in a U form. The web part 16 has its rear part a transversely extending slot 18, in which in the fitted condition to the eccentric, circular cam of the eccentric 13 is arranged. The eccentric 13 possesses additionally a head 19 having a screwdriver slot, the head covering over the slot 18 so that the intermediate plate 5 is held in engagement with the base plate 4. In their front parts the fork limbs 17 of the intermediate plate 5 are provided with slots 20, into which the projecting shanks of the pins 15 fit. The limbs 17 of the intermediate plate 5 fit over the limbs 6 of the base plate 4 so that the intermediate plate 5 is guided on the base plate 4 for longitudinal sliding movement. For longitudinal adjustment and locking in the desired positions the eccentric 13 can be turned with a screwdriver. The limbs 17 have at their front ends rectangularly bent extensions 21, which are provided with slots 22, whose center lines stand perpendicularly on the web part 16.

Figure 9:
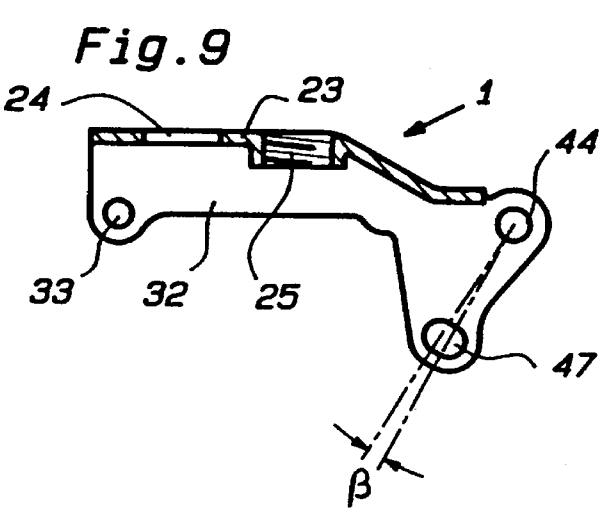
FIG. 9 is a longitudinal section taken through the additional hinge arm of the hinge of FIG. 1.
Figure 10:
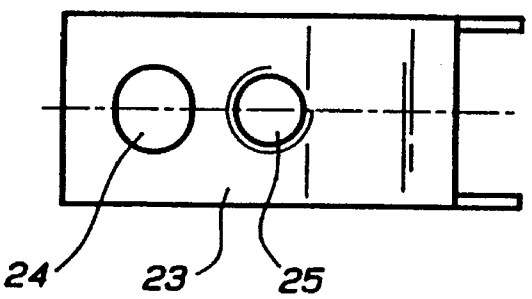
FIG. 10 is a plan view of the hinge arm illustrated in FIG. 9.

The hinge arm 1 also has a U-like configuration or section, the front part of the hinge arm being set at a small angle to the rear part thereof, as best shown in FIG. 9. The web part 23 of the hinge arm is provided with an opening 24 for a screwdriver and with a skirted screw threaded hole 25, into which a set screw 26 is screwed. The set screw 26 has a lower, tapered shank part 27, which extends through a spring washer 28, which is held in place by a rivet head 29 in such a manner that the set screw 26 with the slot is connected in the web part 16 of the intermediate plate 5 slidingly, rotatably and able to be pivoted to a small extent while being held in the axial direction. See FIGS. 1, 3, 4 and 9.

The limbs 32 of the hinge arm are fork limbs and have aligned holes 33 in their rear part. The fork limbs 32 overlap the intermediate plate 5, a pivot pin 35 being received in aligned holes 33 and 34 in the limbs of the intermediate plate for providing a pivotal connection of the hinge arm with the intermediate plate. Owing to the connection of the hinge arm by way of the pivot pin 35 and the set screw 26 with the intermediate plate 5 it is possible to pivot the hinge arm by rotation of the set screw in relation to the intermediate plate 5, the self-locking set screw 26 fixing the hinge arm in the pivot positions set. See FIGS. 1, 3, 4 and 9.

Figure 1:
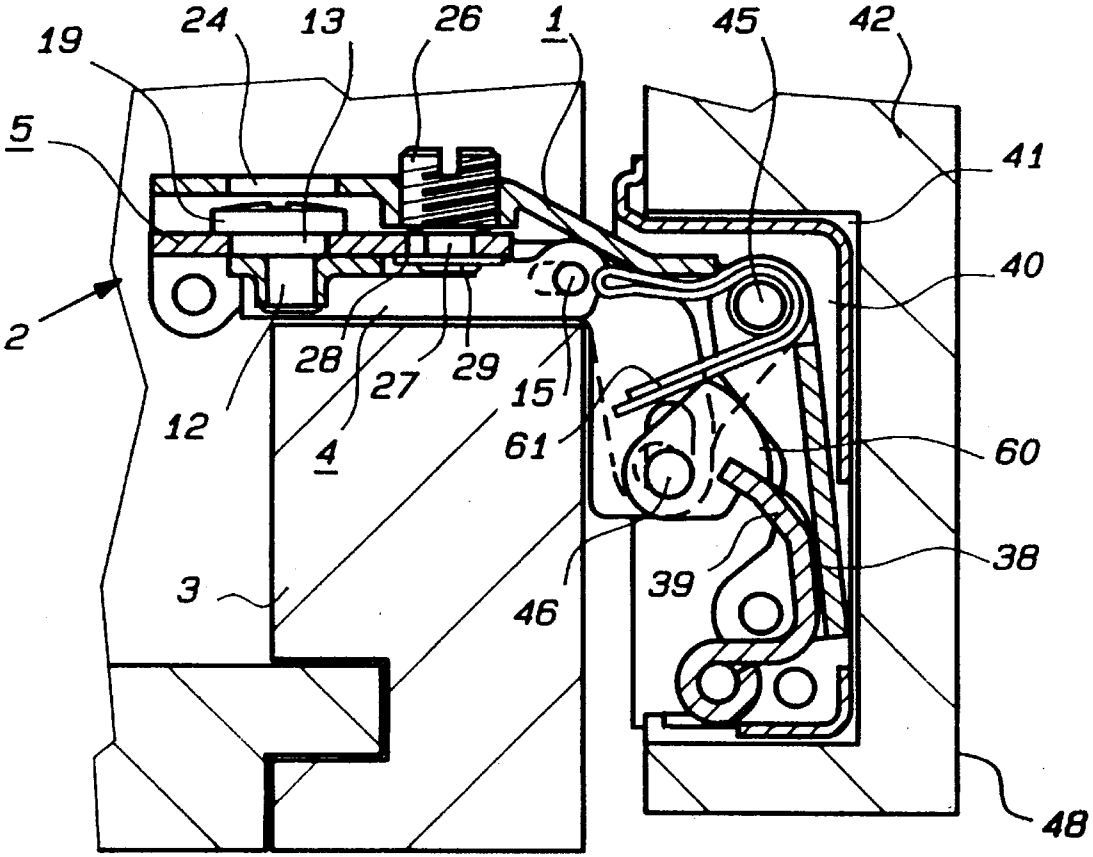
Figure 4:
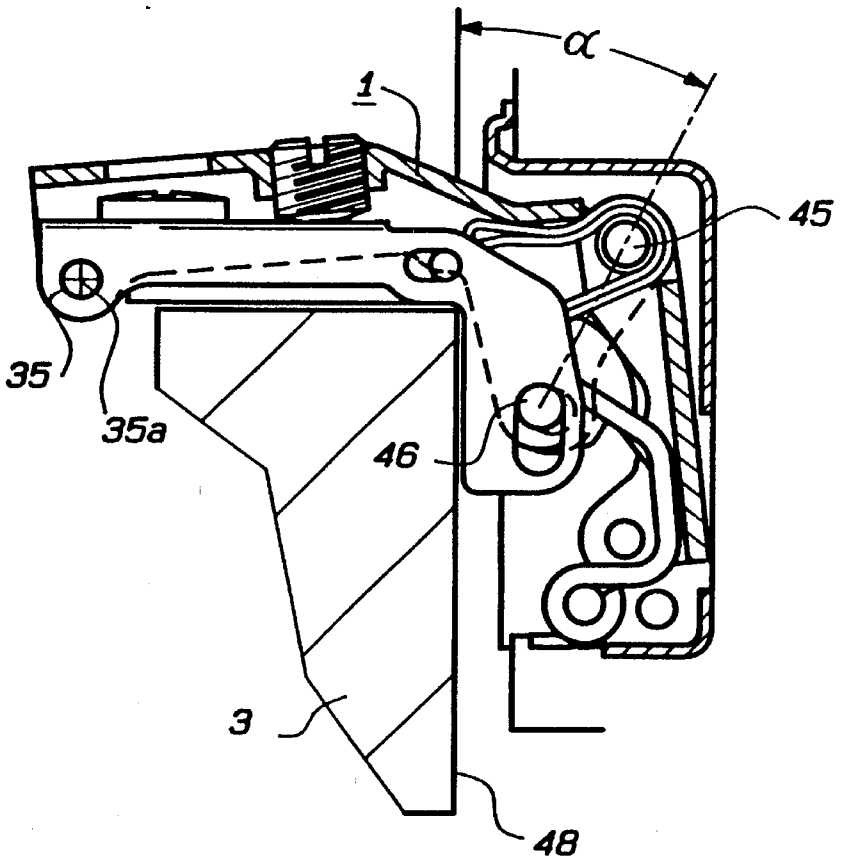
FIG. 4 is a view similar to that of the hinge of FIG. 1 in which, however, the hinge arm is swung in relation to the attachment plate for lateral adjustment of the door.
Figure 3:
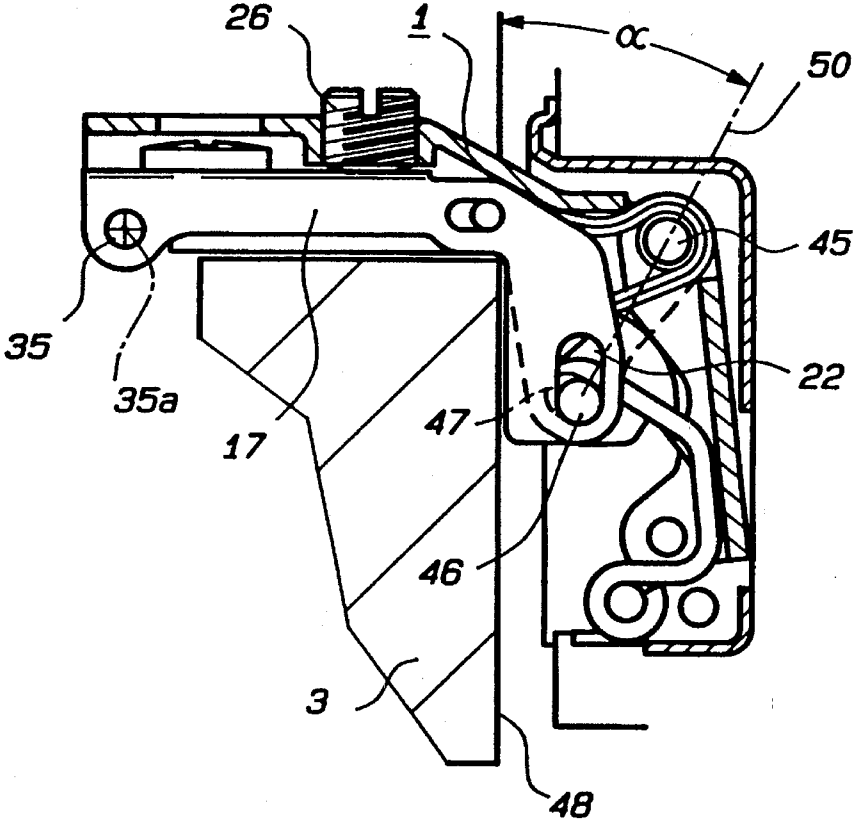
FIG. 3 is a view of the hinge of FIG. 1 in which the attachment plate consisting of the base plate and the intermediate plate is not sectioned.

By means of the links 38 and 39 the movable hinge part 40 is pivotally connected with the hinge arm 1, such movable hinge part consisting of a pot-like hinge part, which in a conventional fashion is set and secured in a hole 41 in a door 42. The link 38 has a U-like configuration, the limbs being provided with holes at the inner ends of the link 38, a hinge pin 45 extending through holes 44 in the limbs 32 of the hinge arm 1 t connect the two together in an articulating manner. The other links bears a pivot pin 46 in holes at its inner end, such pivot pin 46 being held in intersecting slots 22 in the intermediate plate 5 and 47 in the limbs 32 of the hinge arm 1. In the assembled position as shown in FIGS. 1, 3 and 4 of the center lines of the slots 22 in the limbs 17 of the intermediate plate 5 and the slots 47 in the limbs 32 of the hinge arm 1 are at an acute angle so that the pivot pin 46 is held in the respective covered free space of the two slots.

If now for lateral adjustment of the door 42 the hinge arm 1 is pivoted by actuating the set screw 26 in relation to the intermediate plate 5, the pivot pin 46 is shifted in the slot 22 in parallelism to the end side 48 of the frame 3. The displacement is in this case indicated in FIGS. 3 and 4, the hinge arm 1, in FIG. 3 being located in its position parallel to the intermediate plate 5 and being pivoted in FIG. 4 into a displaced position.

In the illustrated working embodiment of the invention on pivoting of the hinge arm 1 about the pivot pin 35 the pivot pin 45 will describe a circular arc about the pivot pin 35. Since, however, the pivoting motion of the pivot in 35 is relatively small, the circular arc of the pivot line may be considered to be the same as the chord. Since furthermore the pivot radius extending through the pivot pin 35 stands perpendicularly on the chord and owing to the placement of the pivot pin 45 in the design, the chord extends generally parallel to the end side 48 of the end frame, the entire joint system will merely undergo a parallel displacement on pivoting of the hinge arm 1. This parallel displacement is indicted in FIGS. 3 and 4. Both in the initial position in accordance with FIG. 3, in which the hinge arm 1 extends in parallelism to the intermediate plate 5, and also at the maximum pivot of the hinge arm 1 the line 50 drawn through the pivot pins 45 and 46 will make the same angle $\alpha$ with the plane of the end side 48 without the system as a whole being rotated despite the pivoting motion of the hinge arm.

The outer ends of the links 38 and 39 are bearinged in a customary fashion in the hinge pot 40. In order to minimize the gap between the door 42 and the end side of the frame 3, both the front end of the hinge arm and also the front end of the intermediate plate 5 with the angled limbs 21 partly extended into the hinge pot.

As shown in the Figures owing to the parallel guiding means the gap between the door 42 and the end side 48 of the frame 3 will remain constant even when the hinge arm 1 is pivoted.

Furthermore, as best shown in FIG. 1, at its inner end the link 39 bears a cam-shaped curve segment 60, which possesses a curve portion concentric to the pivot pin 46, on which there bears one limb of the double layer strip spring 61 (which is bent in the form of a hair pin) in the open position, such spring 61 being held in the illustrated fashion on the pivot pin 45. In the closed position the strip spring 61 bears on the transitional part of the concentric curve part towards a generally radial curve part of the sector-like cam 60 so that the door is urged into its closed position when it is near the same. Since in the case of the hinge in accordance with the invention even a lateral adjustment by pivoting the hinge arm 1 does not alter the mechanical advantages in the limb system, the closing function will not be affected, because the limb system is not subjected to rotation.

The parallel displacement of the joint system in the course of a lateral adjustment, furthermore, leads to the consequence that a lateral adjustment does not impair the maximum possible opening angle.

A hinge in accordance with the invention, in the case of which the hinge pot 40' is merely connected in an articulating fashion by one pivot pin 46' with the hinge arm 1', is depicted in FIG. 2 In the case of this embodiment of the invention, the single pivot pin 46' held in the hinge pot 40' is held both in the slot 22' in the limbs of the intermediate plate and also in the slots 47' in the limbs of the hinge arm 1.

The parallel displacement of the joint system is achieved because owing to its arrangement in relation to the pivot axis 35 of the hinge arm 1 the pivot pin 45 is moved essentially parallel to the end side 48 of the frame 3, whereas in the case of a displacement of the hinge arm 1 by sliding in the transversely extending slot 47 the pivot pin 46 performs a pivoting movement opposite to the hinge arm 1 through the angle $\beta$ (see FIG. 9), which is equal to but opposite to the pivotal motion of the hinge arm 1.

What is claimed is:

1. A furniture hinge comprising a movable hinge part (40) adapted to be connected to a door (42) and which is articulatably connected to a hinge arm (1) by a first pivot pin (45), said arm (1) having a pivot axis 35 and a joint side and being connected to an attachment plate (4 and 5) adapted to be connected to a supporting wall (3) having an end side (48), a set screw (26) for lateral or vertical adjustment of said door (42) to different angular settings in relation to said attachment plate (4 and 5), said screw (26) being screwed into said arm (1) and being mounted turnable in a rotary direction and unmovable in an axial direction in relation to said attachment plate (4 and 5), said attachment plate (4 and 5) including an arm (21), provided with a first slot (22), and which arm (21) overlaps said end side (48) of said supporting wall (3) or of an end frame, said first slot (22) being parallel to a plane formed by said end side (48) and which end side (48) is parallel to said pivot axis (35) of said hinge arm (1) and is in alignment with a second slot (47) located in an end part in the joint side of said hinge arm (1), a second pivot pin (46) located in said first and second slots (22 and 47), and said second slot (47) extends in an end part on the joint side of said hinge arm (1) obliquely or transversely in relation to said first slot (22) in said arm (21) of said attachment plate (4 and 5), whereby said second pivot pin (46) is shifted in position upon swinging of said hinge arm (1) in said first slot (22) of said arm (21).

2. A furniture hinge according to claim 1 wherein the attachment plate (4 and 5) is provided with two fork limbs (17 and 32) and the movable hinge part (40), connected through said two fork limbs (17 and 32) by the first and second pivot pins (45 and 46), is arranged in a rectangle or in a trapezium with the hinge arm (1) and the first and second pivot pins on said hinge arm (1) and the attachment plate (4 and 5) run in first and second slots (22 and 47), which are parallel to the end side of the attachment plate (4 and 5), and in slots in said hinge arm (1) intersecting the latter.

3. A furniture hinge according to claim 1 wherein the first pivot pin (45) is an inner pivot pin and is secured in holes (44) in the hinge arm (1) and the first pivot pin (46) which is an outer pivot pin is secured in intersecting guides formed by the first and second slots (22 and 47) of said hinge arm (1) and of the attachment plate (4 and 5) and said inner pivot pin (45) is arranged in relation to the pivot axis (35) of said hinge arm (1) so that on pivoting of said hinge arm (1) it performs an essentially parallel movement in relation to center line of the first slot (22) in the arm (21) of the attachment plate (4 and 5).

4. A furniture hinge according to claim 2 wherein the first pivot pin (45) is an inner pivot pin and is secured in holes (44) in the hinge arm (1) and the second pivot pin (46) which is an outer pivot pin is secured in intersecting guides formed by the first and second slots (22 and 47) of said hinge arm (1) and of the attachment plate (4 and 5) and said inner pivot pin (45) is arranged in relation to the pivot axis (35) of said hinge arm (1) so that on pivoting of said hinge arm (1) it performs an essentially parallel movement in relation to center line of the first slot (22) in the arm (21) of the attachment plate (4 and 5).

5. A furniture hinge according to claim 1 wherein the first and second slots (22 and 47) are arranged in fork limbs (17 and 32) of the attachment plate (4 and 5) and of the hinge arm (1), respectively.

6. A furniture hinge according to claim 1 wherein the attachment plate (2) consists of a base plate (4) and an intermediate plate (5).

7. A furniture hinge according to claim 6 wherein the hinge arm (1) is pivotally mounted on the intermediate plate (5) and is able to be locked in various different angular settings.

8. A furniture hinge according to claim 6 wherein the intermediate plate (5) is held on the base plate (4) so that it may be longitudinally slid and locked in different positions.

9. A furniture hinge according to claim 8 wherein a self-locking eccentric drive (13) is provided for longitudinal displacement of the intermediate plate (5) on the base plate (4).

10. A furniture hinge according to claim 1 wherein the movable hinge part (40) is pot-shaped.

* * * * *